US008985476B1

(12) United States Patent
O'Connell et al.

(10) Patent No.: US 8,985,476 B1
(45) Date of Patent: Mar. 24, 2015

(54) RAIL COVER AND CLIP SYSTEM FOR EMBEDDED TRACK SYSTEMS

(75) Inventors: Michael O'Connell, Atlanta, GA (US); Robert Alsop, Tucker, GA (US)

(73) Assignee: L. B. Foster Company, Pittsburgh, PA (US)

( * ) Notice: Subject to any disclaimer, the term of this patent is extended or adjusted under 35 U.S.C. 154(b) by 230 days.

(21) Appl. No.: 13/440,914

(22) Filed: Apr. 5, 2012

Related U.S. Application Data

(60) Provisional application No. 61/472,021, filed on Apr. 5, 2011.

(51) Int. Cl.
*E01B 1/00* (2006.01)

(52) U.S. Cl.
USPC ..... 238/8

(58) Field of Classification Search
CPC ..... E01B 13/00; E01B 13/02; E01B 21/00; E01B 21/04; E01B 25/00; E01C 9/00; E01C 9/002
USPC ..... 238/2–9, 121, 122, 143
See application file for complete search history.

(56) References Cited

U.S. PATENT DOCUMENTS 6,588,677 B2 * 7/2003 Hofstetter et al. ..... 238/283
8,172,158 B1 * 5/2012 Burkhardt et al. ..... 238/8

* cited by examiner

*Primary Examiner* — R. J. McCarry, Jr.
(74) *Attorney, Agent, or Firm* — Paul D. Bangor, Jr.; Clark Hill PLC

(57) ABSTRACT

An assembly to hold a rail boot to a rail during embedded track construction comprising: a cover having a bottom surface, a first portion of the bottom surface generally conforming to a length of a top surface of a rail head; the bottom surface having a second portion defining a convex shape adjacent to and generally parallel to the length of the top surface of the rail head; the bottom surface further defining a hook to engage a gauge side of the rail boot; and a clip having first and second ends, wherein the first end engages a gauge side of the cover; and the second end engages a field side of the cover and/or the rail boot.

16 Claims, 4 Drawing Sheets

RAIL COVER AND CLIP SYSTEM FOR EMBEDDED TRACK SYSTEMS

CROSS REFERENCE TO RELATED APPLICATIONS

The present application claims benefit and priority from U.S. provisional application Ser. No. 61/472,021 entitled "RAIL COVER AND CLIP SYSTEM FOR EMBEDDED TRACK SYSTEM", filed Apr. 5, 2011, the disclosure of which is hereby incorporated by reference herein in its entirety for all purposes.

FIELD OF THE INVENTION

This invention is related to a cover and clip to cover a rail and rail boot during the construction of embedded railway tracks.

BACKGROUND OF THE INVENTION

Rail beds cross a roadway or a pedestrian walkway at grade level or are built into a roadway when right-of-way is shared between tram vehicles with steel wheels and automobiles with rubber tires. In these rail beds, the rails are often installed such that the top surface of the rails are at the same level as the roadway or walkway with the exception of a flangeway, an adjacent recess to accommodate the rail car wheels. The non-exposed surfaces of the rails are often covered with an elastomeric rail boot to cushion or to electrically insulate the rail from the concrete. This type of rail track is called "embedded track" since the rail and other ancillary components are embedded in the track except the exposed surface of the rail There are various construction methods for building embedded track. One method for building embedded track, especially in the U.S., is done by laying a rubber boot underneath a rail that has been suspended by gigging. The rail boot is then wrapped around the rail. As shown in FIG. 1, a flangeway filler is then inserted onto one side of the rail boot. As the flangeway filler is cantilevered away from the rail, it must be supported by rigid brackets. Rigid brackets are applied underneath the boot and the flangeway filler at intervals. Rail head tape is then applied to cover the rail boot, rail, and flangeway filler. After concrete is poured, the rail head tape is removed. The current installation system requires significant labor, uses significant amounts of materials and generates waste.

BRIEF SUMMARY OF THE INVENTION

In a first aspect, the present invention comprises an assembly to hold a rail boot to a rail during embedded track construction comprising: a cover having a bottom surface, a first portion of the bottom surface generally conforming to a length of a top surface of a rail head; the bottom surface having a second portion defining a convex shape adjacent to and generally parallel to the length of the top surface of the rail head; the bottom surface further defining a hook to engage a gauge side of the rail boot; and a clip having first and second ends, wherein the first end engages a gauge side of the cover; and the second end engages a field side of the cover and/or the rail boot.

In accordance with another aspect of the assembly of the present invention, the first end of the clip snap-fits or friction fits the gauge side of the cover.

In accordance with yet an additional aspect of the assembly of the present invention, the second end of the clip snap-fits or friction fits the field side of the cover and/or rail boot.

In accordance with yet a further aspect of the assembly of the present invention, the first end of the clip snap-fits or friction fits the gauge side of the cover and wherein the second end of the clip snap-fits or friction fits the field side of the cover and/or rail boot.

In accordance with another aspect of the assembly of the present invention, the cover may comprise an extrusion, polyvinylchloride and/or nylon.

In accordance with yet a further aspect of the assembly of the present invention, the clip may comprise an injection molded product, polybutylene terephthalate or a metal.

In another aspect, the present invention comprises a method for covering a rail and rail boot during the construction of embedded railway tracks comprising the steps of: wrapping a rail boot around, in-whole or in-part, a flange, field side web and/or gauge side web of a rail; laying a cover over a head of the rail; engaging the cover with a gauge side of the rail boot; engaging a clip to the cover and to the field side of the rail boot; pouring material around the rail boot; removing the clip; and removing the cover.

In accordance with yet a further aspect, the method for covering of the present invention further comprises: applying a concrete release agent to the clip and/or cover.

In accordance with yet a further aspect of the method for covering of the present invention, the cover has a bottom surface having first and second portions wherein the first portion of the bottom surface generally conforms to a length of a top surface of a rail head.

In accordance with yet another aspect of the method for covering of the present invention, the second portion of the bottom surface defines a convex shape adjacent to and generally parallel to the length of the top surface of the rail head.

In accordance with yet an additional aspect of the method for covering of the present invention, the bottom surface further defines a hook to engage a gauge side of the rail boot.

In accordance with yet a further aspect of the method for covering of the present invention, the clip has first and second ends, wherein the first end engages a gauge side of the cover; and the second end engages a field side of the cover and/or the rail boot.

BRIEF DESCRIPTION OF THE SEVERAL VIEWS OF THE DRAWINGS

For the present disclosure to be easily understood and readily practiced, the present disclosure will now be described for purposes of illustration and not limitation in connection with the following figures, wherein.

DETAILED DESCRIPTION OF PREFERRED EMBODIMENT(S) OF THE INVENTION

In the following detailed description, reference is made to the accompanying examples and figures that form a part hereof, and in which is shown, by way of illustration, specific embodiments in which the inventive subject matter may be practiced. These embodiments are described in sufficient detail to enable those skilled in the art to practice them, and it is to be understood that other embodiments may be utilized and that structural or logical changes may be made without departing from the scope of the inventive subject matter. Such embodiments of the inventive subject matter may be referred to, individually and/or collectively, herein by the term "invention" merely for convenience and without intending to voluntarily limit the scope of this application to any single invention or inventive concept if more than one is in fact disclosed.

The following description is, therefore, not to be taken in a limited sense, and the scope of the inventive subject matter is defined by the appended claims and their equivalents.

Figure 1:
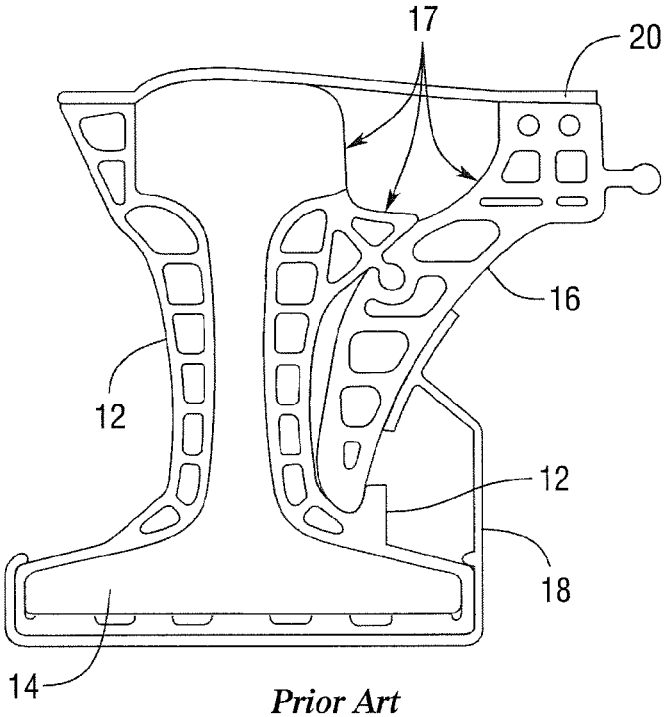
Prior Art Fig.1
FIG. 1 is drawing showing a prior art method for building embedded track.

In one prior art method for building embedded track, FIG. 1, a rubber rail boot 12 is laid underneath a rail 14 that has been suspended by gigging. The rail boot 12 is then wrapped around the rail. A flangeway filler 16 is inserted onto one side of the rail boot 12. As the flangeway filler 16 is cantilevered away from the rail 14, it must be supported by rigid brackets 18. Rigid brackets 18 are applied underneath the rail boot 12 and the flangeway filler 16 at intervals. Rail head tape 20 is then applied to cover the rail boot 12, rail 14, and flangeway filler 16. After concrete is poured to the approximate height of the rail boot 12, rail head tape 20 is removed. The U-shaped space 17 formed from rail 14, rail boot 12, and flangeway filler 16 is a flangeway adjacent to the rail 14 to accommodate railway wheel flanges.

A preferred cover and clip of the present invention takes the place of the rail head tape, flangeway fillers, and rigid brackets in the installation of embedded railroad track. This allows reuse of materials, less labor and less generated waste.

As shown in FIGS. 2-7, a preferred embodiment of a rail cover and clip system of the present invention comprises a cover 26 having a bottom surface 60, a first portion 62 of the bottom surface 60 conforming to a breadth and a significant portion of the long dimension of a top surface 66 of a rail head 42. The bottom surface 60 has a second portion 64 having a generally convex or bullnose shape adjacent to and parallel to the long dimension of the top surface 66 of the rail head 42. The convex or bullnose shape further comprising means to engage the gauge side of a rail boot 22. The clip 28 having first end 33 and second end 34, wherein the first end 33 comprises a first clip means to engage a gauge side 51 of the cover 26. The second end 34 comprises a second clip means to engage the cover 26 and/or the field side 36 of rail boot 22.

Figure 2:
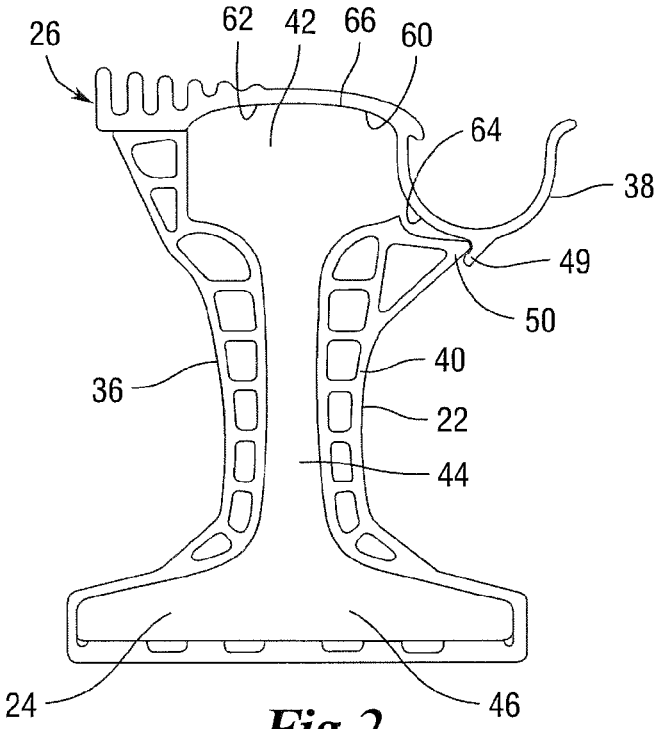
FIG. 2 is a cross-sectional view of a preferred rail cover and clip system of the present invention.
Figure 3:
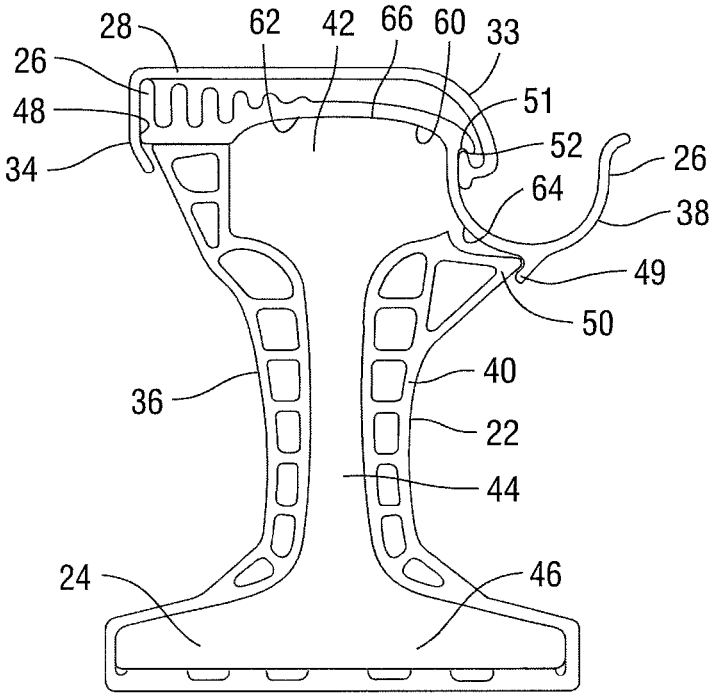
FIG. 3 is a cross-sectional view of the rail cover and clip system of FIG. 2 showing an attached clip on the cover.
Figure 4:
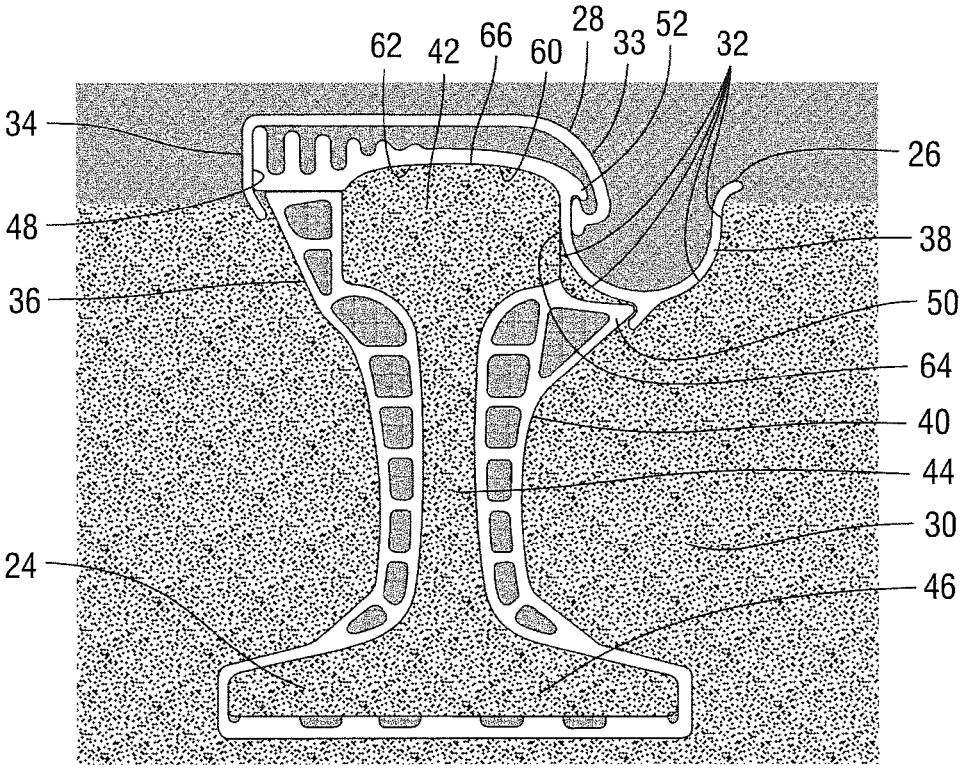
FIG. 4 is a cross-sectional view of the rail cover and clip system of FIG. 2 in use.

According to a preferred embodiment of the present invention, a rail boot 22 is positioned and wrapped around a rail 24 as shown in FIG. 2. As also shown in FIG. 2, cover 26 is placed over the rail 24 and rail boot 22. Clips 28 secure the cover 26 to the rail 24 and rail boot 22 assembly as shown in FIG. 3. Concrete 30 is poured to a predetermined level as shown in FIG. 4. After the concrete 30 has been poured, the covers 26 and clips 28 can be removed and reused on another rail assembly segment.

In a preferred system of the present invention, a flangeway 32 is formed during the concrete pour. As the preferred system has no cantilevered flangeway filler 16 gravitationally pulling on rail boot 22, rail boot 22 of the preferred system has a reduced tendency to pull away from rail 24 during assembly, as compared to the assembly of FIG. 1. Covers 26 and clips 28 protect the exposed rail 24 and rail boot 22 from the concrete 30, and in preferred embodiments holds the rail boot 22 and secures it to the rail 24 during the concrete pour.

Figure 5A:
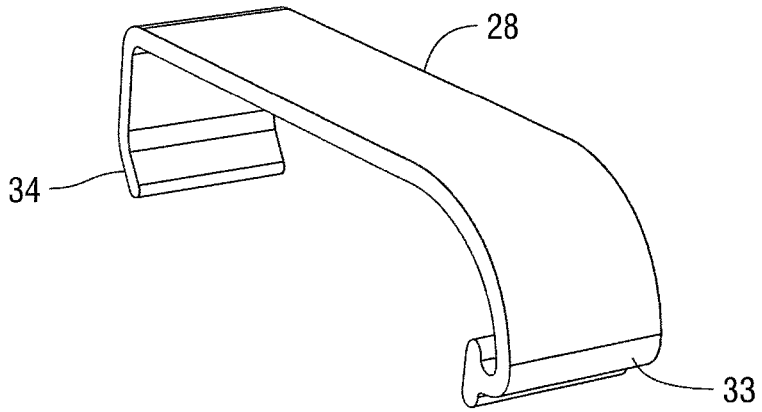
FIG. 5*a* is perspective drawing of the preferred clip of FIG. 3.
Figure 5B:
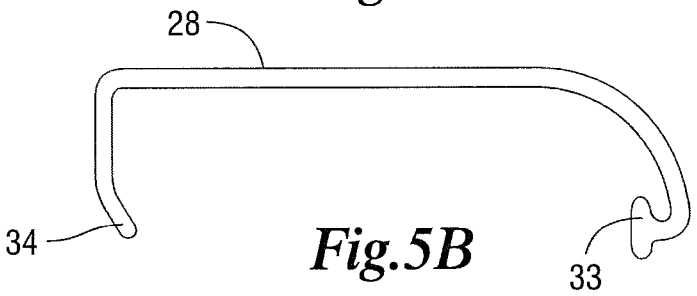
FIG. 5*b* is a cross-sectional view of the preferred clip of FIG. 3.
Figure 6A:
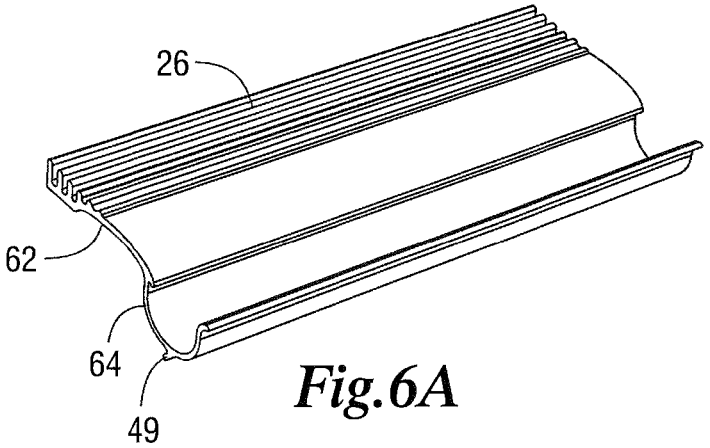
FIG. 6*a* is perspective drawing of the preferred cover of FIG. 2.
Figure 6B:
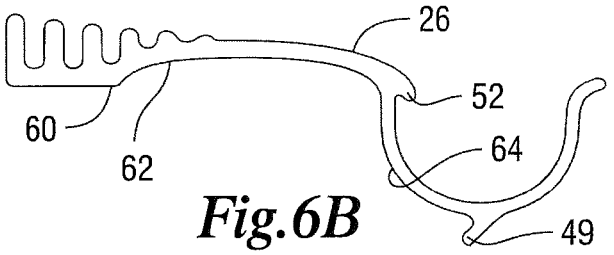
FIG. 6*b* is a cross-sectional view of the preferred cover of FIG. 2.
Figure 7:
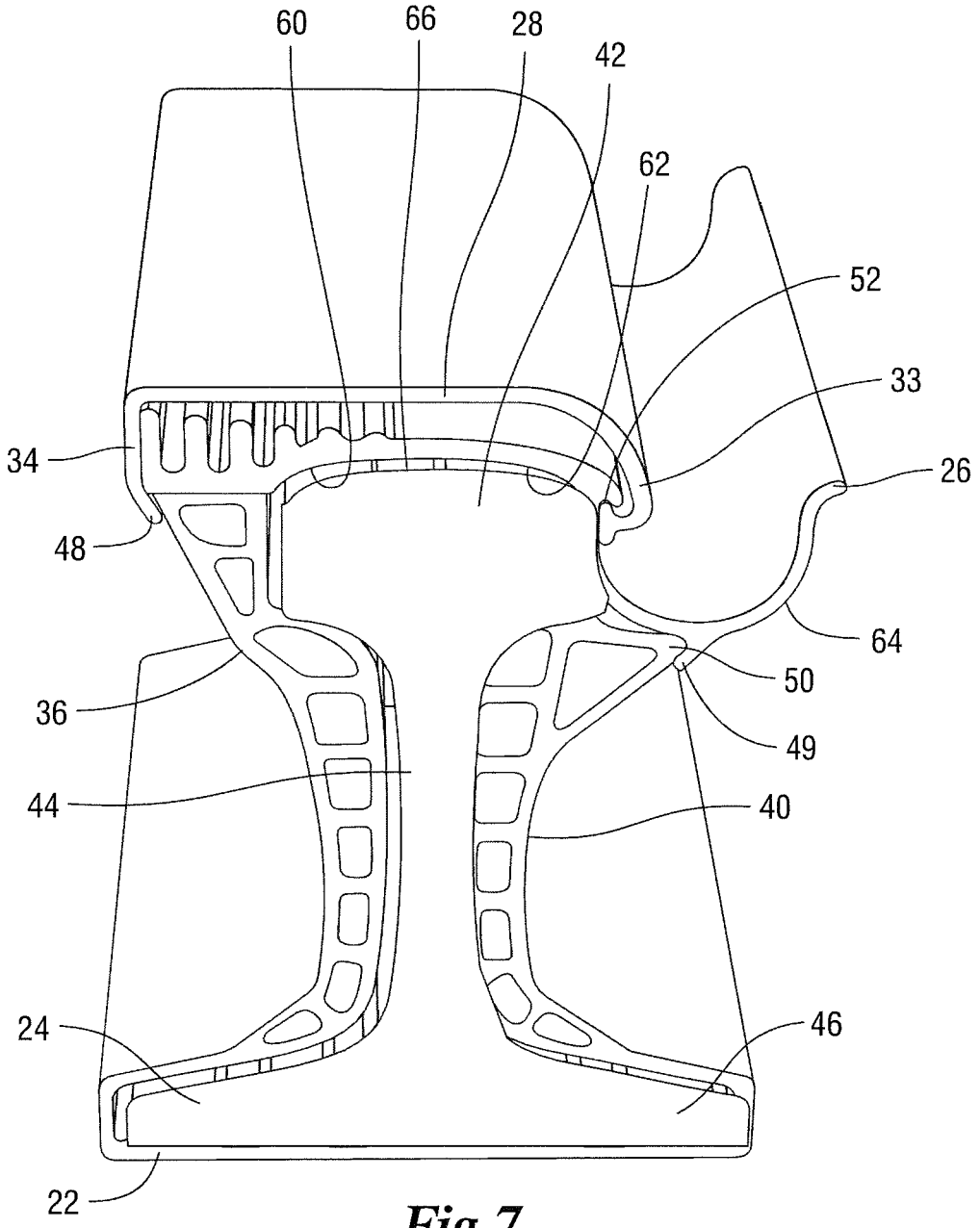
FIG. 7 is an end-view of the preferred clip and cover of FIG. 3 with rail and rail boot.

An additional advantage is the flangeway 32 formed of long-lasting concrete instead of exposed rubber as in flangeway filler 16. Cover 26 is designed to fit over the contours of the rail head 42 and hook onto the side of the rail boot 22 at 50 as shown in FIGS. 3-4 and 6. As shown in FIG. 5, the clip 28 has a first end 33 and a second end 34. The clip first end 33 may be hooked over the cover 26 at 52 and the clip second end 34 may be hooked over the cover 26 and rail boot 22 at 48 as shown in FIG. 3-4.

In a preferred embodiment, covers 26 and clips 28 are reusable. In some preferred embodiments, the clips 28 are injection molded products made from a plastic such as nylon or polybutylene teraphthalate (PBT). In other preferred embodiments, the clip 28 is made of metal. In a preferred embodiment, the clips 28 engage the cover 26 on the field side 36 of the rail boot 22 at 48 and most preferably the clips 28 make a snap-fit to the cover 26 at 52 and on the field side 36 of the rail boot 22 at 48.

In a preferred embodiment, covers 26 are reusable and are an extruded product made from a polyvinyl chloride (PVC). The profile of the cover 26 preferably forms a U-shape 38 on the gauge side 40 of the rail 24. In preferred embodiments, the U-shape 38 acts as a mould during the concrete pour that creates the flangeway 32 to accommodate railway wheel flanges. In most preferred embodiments, the hook 49 of cover 26 engages the gauge side 40 of the rail boot 22 at 50 as shown in FIG. 3-4.

The cover and clip system is used as follows. The rail boot 22 is positioned and wrapped around a flange 46 of the rail 24, the rail boot 22 extending also to the field side 36 and gauge side 40 of the rail 24. A cover 26 is placed over the rail 24 and rail boot 22. The cover 26 engages the gauge side 40 of the rail boot 22 at 49, 50. Clips 28 are then applied to secure the cover 26 to the rail 24 and rail boot 22 assembly as shown in FIG. 3. Concrete 30 or other road material is poured as shown in FIG. 4. A flangeway 32 is formed during the concrete pour. Covers 26 and clips 28 can be then removed and reused on another rail assembly segment. In a preferred embodiment, a concrete release agent, such as an oil, is applied to concrete contacting surfaces of the clips 28 and/or covers 26.

As the preferred system has no cantilevered flangeway filler 16 gravitationally pulling on rail boot 22, which, therefore, has a reduced tendency to pull away from rail 24 during assembly, as compared to the assembly of FIG. 1. Covers 26 and clips 28 protect the exposed rail 24 and rail boot 22 from the concrete 30, and in preferred embodiments holds the rail boot 22 and secures it to the rail 24 during the concrete pour.

The rail 24 and rail boots 22 shown in the drawings are for illustrative purposes only as many types of rails 24 and rail boots 22 may be used with the cover 26 and clip 28 assembly of a preferred embodiment of the present invention. The road material may be concrete, asphalt or paver construction material. The standard rail 24 has a head or upper portion 42, a web 44 or connecting central portion, and a flange or lower portion 46. The outside of the rail will be referred to as the field side 36, being the left half of FIG. 2. The inside of the rail will be referred to as the gauge side 40, being the right half of FIG. 2.

In the foregoing Detailed Description, various features are grouped together in a single embodiment to streamline the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. An assembly to hold a rail boot to a rail during embedded track construction comprising:

a cover having a bottom surface, a first portion of the bottom surface generally conforming to a length of a top surface of a rail head;

the bottom surface having a second portion defining a convex shape adjacent to and generally parallel to the length of the top surface of the rail head;

the bottom surface further defining a hook to engage a gauge side of the rail boot; and a clip having first and second ends, wherein the first end engages a gauge side of the cover; and the second end engages a field side of the cover and/or the rail boot.

2. The assembly of claim 1, wherein the first end of the clip snap-fits or friction fits the gauge side of the cover.

3. The assembly of claim 1, wherein the second end of the clip snap-fits or friction fits the field side of the cover and/or rail boot.

4. The assembly of claim 1, wherein the first end of the clip snap-fits or friction fits the gauge side of the cover and wherein the second end of the clip snap-fits or friction fits the field side of the cover and/or rail boot.

5. The assembly of claim 1, wherein the cover comprises an extrusion.

6. The assembly of claim 5, wherein the cover comprises polyvinylchloride.

7. The assembly of claim 5, wherein the cover comprises nylon.

8. The assembly of claim 1, wherein the clip comprises an injection molded product.

9. The assembly of claim 8, wherein the clip comprises polybutylene terephthalate.

10. The assembly of claim 1, wherein the clip comprises a metal.

11. A method for covering a rail and rail boot during the construction of embedded railway tracks comprising the steps of: wrapping a rail boot around, in-whole or in-part, a flange, field side web and/or gauge side web of a rail; laying a cover over a head of the rail; engaging the cover with a gauge side of the rail boot; engaging a clip to the cover and to the field side of the rail boot; pouring material around the rail boot; removing the clip; and removing the cover.

12. The method for covering of claim 11, further comprising applying a concrete release agent to the clip and/or cover.

13. The method for covering of claim 11, wherein the cover has a bottom surface having first and second portions wherein the first portion of the bottom surface generally conforms to a length of a top surface of a rail head.

14. The method for covering of claim 13, wherein the second portion of the bottom surface defines a convex shape adjacent to and generally parallel to the length of the top surface of the rail head.

15. The method for covering of claim 13, wherein the bottom surface further defines a hook to engage a gauge side of the rail boot.

16. The method for covering of claim 13, wherein the clip has first and second ends, wherein the first end engages a gauge side of the cover; and the second end engages a field side of the cover and/or the rail boot.

* * * * *